US005228300A

United States Patent [19]

Shim

[11] Patent Number: 5,228,300

[45] Date of Patent: Jul. 20, 1993

[54] AUTOMATIC OPERATION CONTROL METHOD OF A REFRIGERATOR

[75] Inventor: Jae E. Shim, Seoul, Rep. of Korea

[73] Assignee: Samsung Electronics Co., Ltd., Suweon, Rep. of Korea

[21] Appl. No.: 894,908

[22] Filed: Jun. 8, 1992

[30] Foreign Application Priority Data

Jun. 7, 1991 [KR] Rep. of Korea ..... 91-9426

[51] Int. Cl.[5] ..... F25D 21/00; F25B 49/00

[52] U.S. Cl. ..... 62/80; 62/153; 62/162; 62/163; 62/186; 62/229; 62/131

[58] Field of Search ..... 62/126, 131, 151, 153, 62/155, 161, 162, 163, 164, 229, 208, 209, 228.1, 228.2, 228.3, 213, 80, 81, 82

[56] References Cited

U.S. PATENT DOCUMENTS 4,297,852 11/1981 Brooks ..... 62/153
4,327,556 5/1982 Zampini et al. ..... 62/153
4,481,785 11/1984 Tershak et al. ..... 62/153
5,003,785 4/1991 Petri et al. ..... 62/131
5,065,587 11/1991 Howland et al. ..... 62/131

*Primary Examiner*—Harry B. Tanner
*Attorney, Agent, or Firm*—Burns, Doane, Swecker & Mathis

[57] ABSTRACT

An automatic operation control method automatically controls the temperature setting of a chamber, the defrost cycling and the operation of a compressor and a fan motor according to the door open/close frequency and open time. The defrost cycling is operated during a predetermined time period or an auxiliary time period according to the usage frequency of a refrigerator and the door open time before entering into the defrost cycle while being started after dropping the chamber temperature according to the current state of a temperature adjuster and the average value of the chamber temperature. The operation of a compressor and a fan motor is retarded to prevent the chamber temperature from increasing after the completion of the defrost cycling, thereby minimizing the temperature change of the chamber to protect the stored food.

7 Claims, 18 Drawing Sheets

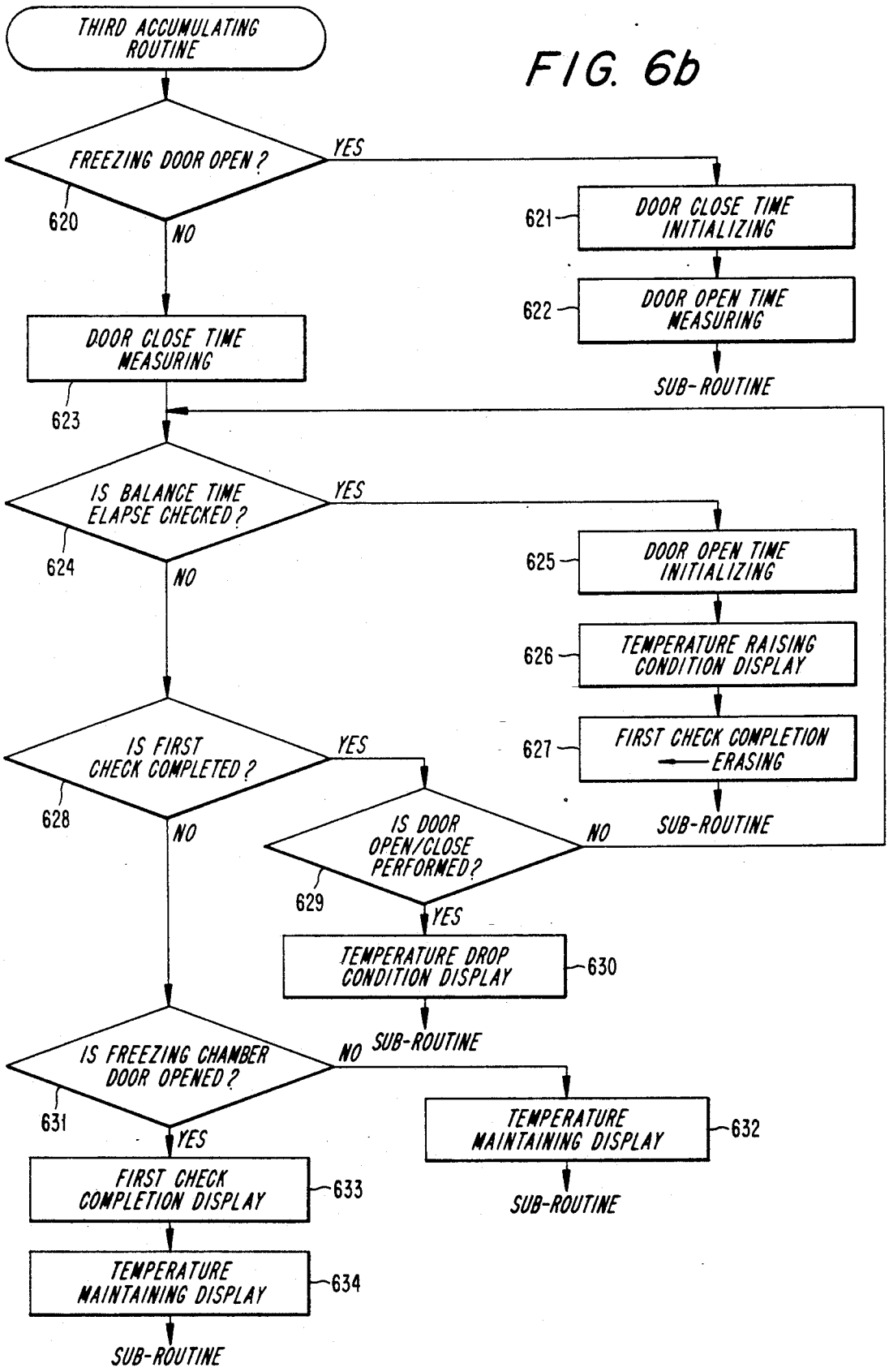
THIRD ACCUMULATING ROUTINE
FIG. 6b
FREEZING DOOR OPEN ?
YES
NO
620
621
DOOR CLOSE TIME INITIALIZING
622
DOOR OPEN TIME MEASURING
SUB-ROUTINE
DOOR CLOSE TIME MEASURING
623
IS BALANCE TIME ELAPSE CHECKED ?
YES
NO
624
625
DOOR OPEN TIME INITIALIZING
626
TEMPERATURE RAISING CONDITION DISPLAY
627
FIRST CHECK COMPLETION ERASING
SUB-ROUTINE
IS FIRST CHECK COMPLETED ?
YES
NO
628
IS DOOR OPEN/CLOSE PERFORMED ?
NO
YES
629
TEMPERATURE DROP CONDITION DISPLAY
630
SUB-ROUTINE
IS FREEZING CHAMBER DOOR OPENED ?
NO
YES
631
TEMPERATURE MAINTAINING DISPLAY
632
SUB-ROUTINE
FIRST CHECK COMPLETION DISPLAY
633
TEMPERATURE MAINTAINING DISPLAY
634
SUB-ROUTINE

AUTOMATIC OPERATION CONTROL METHOD OF A REFRIGERATOR

BACKGROUND OF THE INVENTION

The present invention is related to providing an automatic operation control method of a refrigerator for automatically controlling the inner temperature setting of a chamber, a defrost cycle, a compressor and a fan motor based on the open/close frequency and open times of a door and maintaining the chamber temperature at the optimum state.

PRIOR ART

A refrigerator is generally supposed to maintain its chamber at a predetermined temperature according to the setting position of a temperature adjuster set by the user while ignoring environment factors. If the usage frequency of the refrigerator increases, the chamber temperature is lowered due to the inflow of the exterior warmer air, and the compressor is often operated at the lower temperature to raise the chamber temperature to the setting temperature. The refrigerator entered directly entered into the defrost cycle. The chamber temperature is again measured to set the temperature suitable for the defrost. The defrost operation is determined based on the setting position of a temperature adjuster and the average value of the chamber temperature. The fan motor is driven, if the chamber temperature was lowered before entering into the defrost cycle. It has a disadvantage that the difference of the chamber temperature between the on-state period and off-state periods of the compressor is very large. Furthermore, even though its usage frequency is small, the defrost cycle is unconditionally initiated at the previous set time independent of the chamber temperature. This leads to the consumption of unnecessary electric power.

In order to overcome these problems, a typical example is described in U.S. Pat. No. 4,297,852. This patent relates to the automatic control of defrost timing in which intervals between defrost cycles are varied as a function of minimum compressor run time and refrigerator usage as measured by door open time. The refrigerator prolongs the time interval between defrost cycles to reduce the energy consumption during its chamber light usage period. In other words, door open time in an automatic defrost refrigerator is accumulated in the memory of a microcomputer. Normal cycling of defrost is delayed by deactivating the defrost timer during periods of light usage of the refrigerator until a minimum predetermined accumulated door open time is reached. Provision is made for sensing interior refrigerator temperature to override the delaying effect of the door open measurement when a sensed over-temperature condition indicates an abnormal build-up of frost on the evaporator coils even though the refrigerator is experiencing relatively light usage. A maximum compressor run time interval between defrost cycles is provided for when no door openings occur, as during vacation periods. Herein, it is noted that the defrost timer is turned on or off based on the previous setting compressor run time and the current chamber temperature to control the defrost cycle according to the refrigerator usage frequency. But, the system fails to compensate for the temperature rise which accompanies the defrost operation. It is impossible to maintain the chamber temperature at the setting temperature. The system does not show the co-relationship of the compressor and defrost heater cooperating with the other equipment. Therefore, the control temperature of a refrigerator based on the automatic or manual temperature adjusting is insufficient with respect to total system control.

An object of the present invention is to provide an automatic operation control system of a refrigerator for automatically adjusting the chamber temperature based on the automatic and manual temperature settings.

Another object of the present invention is to provide an automatic operation control method of a refrigerator for automatically controlling the temperature setting of a chamber, a defrost cycle, a compressor and a fan motor based on the open/close frequency and open time of a door, thereby maintaining the chamber temperature at the optimum state.

Also, another object of the present invention is to provide an automatic operation control method of a refrigerator for calculating the open/close frequency and open door time enabling the defrost time to be extended or fixed according to the calculated result during the predetermined defrost cycling period after the defrost throwing-in.

Still another object of the present invention is to provide an automatic operation control method of a refrigerator for determining the average chamber temperature increase when a temperature adjuster is set at a high temperature, dropping the average chamber temperature below the predetermined temperature based on the average temperature of the temperature adjuster and the chamber, and entering the defrost cycle. Further operating the compressor and the fan motor are operated for a predetermined time when the chamber temperature rises after completing the defrost operation. Additionally, the chamber temperature is maintained at a uniform state while preventing the warmer air from being introduced into the chamber, thereby preventing the deterioration of food stored in the chamber.

SUMMARY OF THE INVENTION

According to the present invention, an automatic operation control method of a refrigerator comprises an initializing step of clearing data stored in all memory when the power source is applied to a control portion; and interrupt routine for issuing interrupt signals to the control portion to perform each of sub-routines within a predetermined time; a scan routine for scanning input signals selected/sensed from a function selecting portion, a key input portion, a temperature controlling portion and a temperature sensing portion during the interrupt routine; an input checking routine for reading/checking key signals inputted from the key input portion; a temperature A/D converting routine for converting the analog signals of temperature sensed from freezing and refrigerating chambers and a temperature adjuster into digital signals; a first accumulating routine for calculating the average value of the maximum and minimum values of the freezing chamber temperature; a second accumulating routine for calculating the average value of the maximum and minimum values of the refrigerating chamber temperature; a third routine for calculating the open/close frequency and open time of each of the freezing/refrigerating chambers and performing the automatic adjustment; a temperature adjusting routine for processing the freezing chamber temperature to be forced into the refrigerating chamber temperature condition according to the temperature A/D converting routine, the input signal check routine, and the first, second and third accumulating routines; a compressor control routine for adjusting the chamber temperature at a suitable temperature according to the result of the temperature adjusting routine and the chamber temperature difference; a sub driving control routine for properly driving a fan motor, a chamber light and a heater according to the open/close and open time of each of the freezing and refrigerating chamber and the on-off of the compressor; a display routine for representing the temperature and the temperature select conditions considered as the final results of the above routines; a routine for controlling the compressor by accumulating the compressor operation time and determining whether the defrost cycle must be started based on the average chamber temperature; a routine for controlling the defrost cycle; and a timer routine for operating a timer based on the frequency of a power source.

Accordingly, the present invention permits the refrigerator control to select any one of "an automatic operation" and "a manual operation" while switching the temperature adjuster automatically, according to the chamber temperature and the usage frequency of a refrigerator. Thus, the present invention changes the defrost cycle or controls the defrost cycle based on the previous set time according to the usage frequency of the refrigerator before entering into the defrost cycle, and lowers the chamber temperature according to the current state of the temperature adjuster and the average value of the chamber temperature to minimize the temperature change of the chamber. A fan motor drive is also delayed according to the on-off of the chamber temperature adjusting control to minimize the temperature change of the chamber. Furthermore, the present invention forces the current temperature to be slowly reduced if the refrigerating chamber temperature increases, thereby minimizing the temperature change of the chamber to protect the stored food and to reduce the consumption of power.

BRIEF DESCRIPTION OF THE DRAWINGS

The present invention will now be explained in detail with reference to the attached drawings, wherein.

Figure 4:
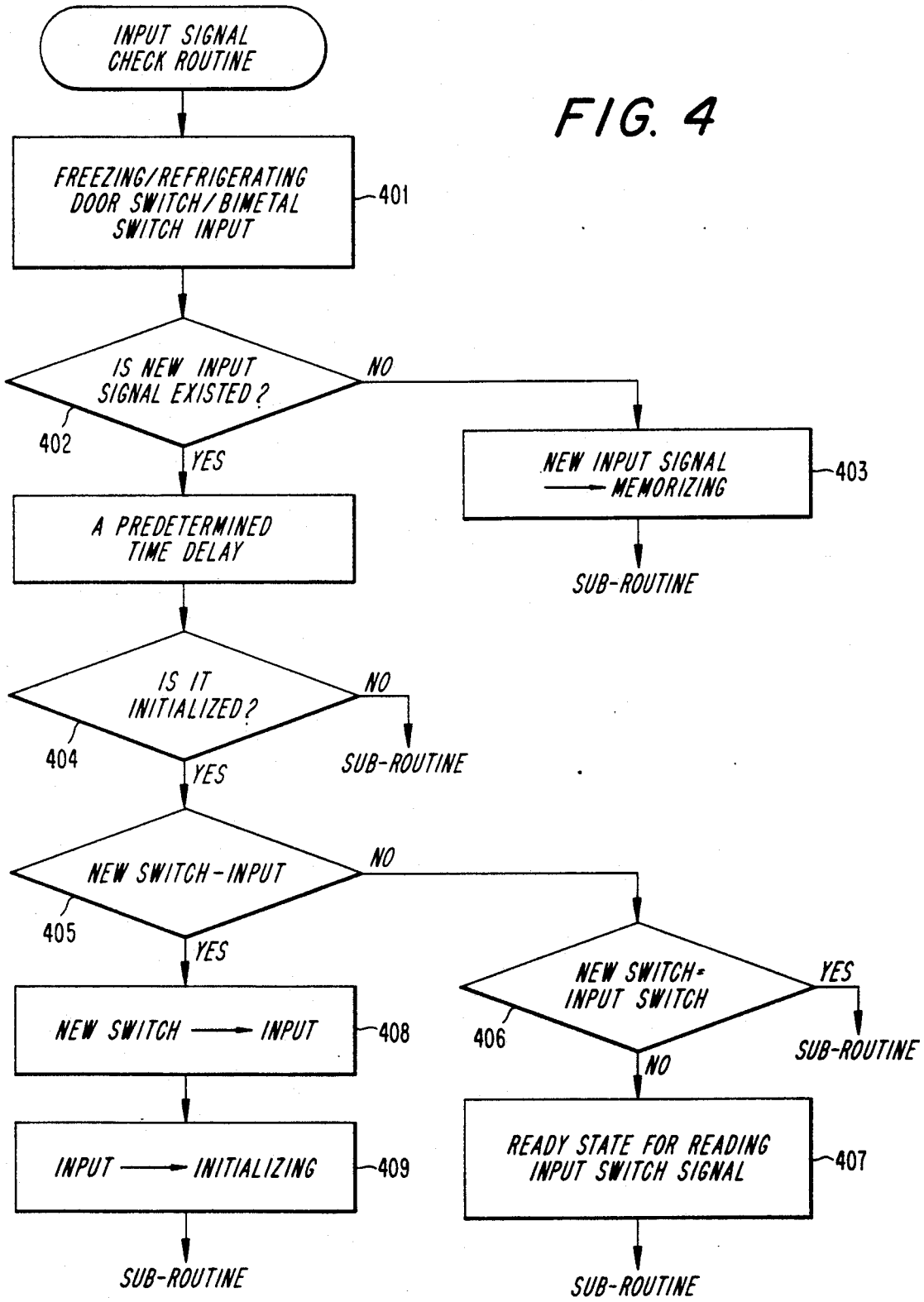
Figure 5:
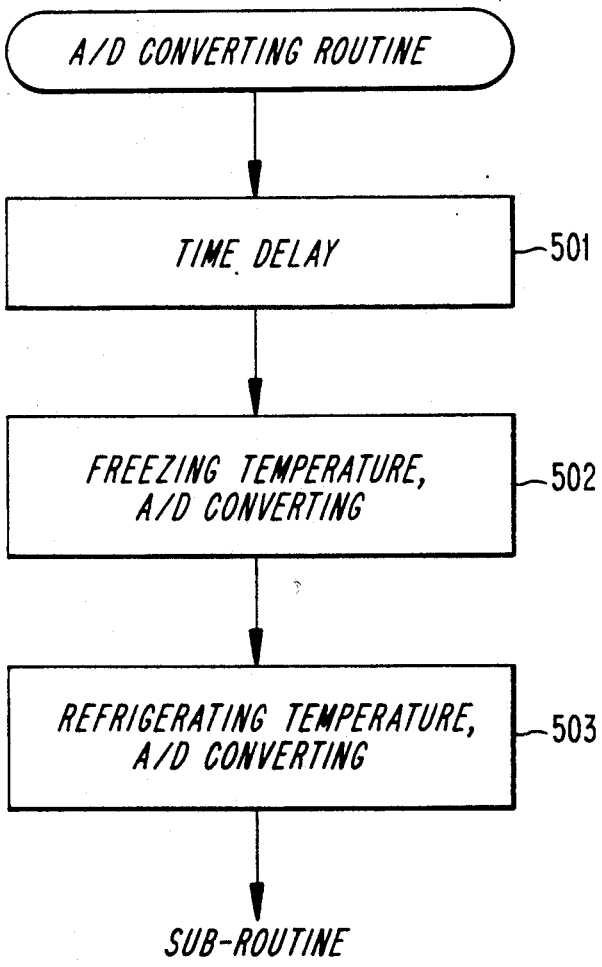
Figure 8:
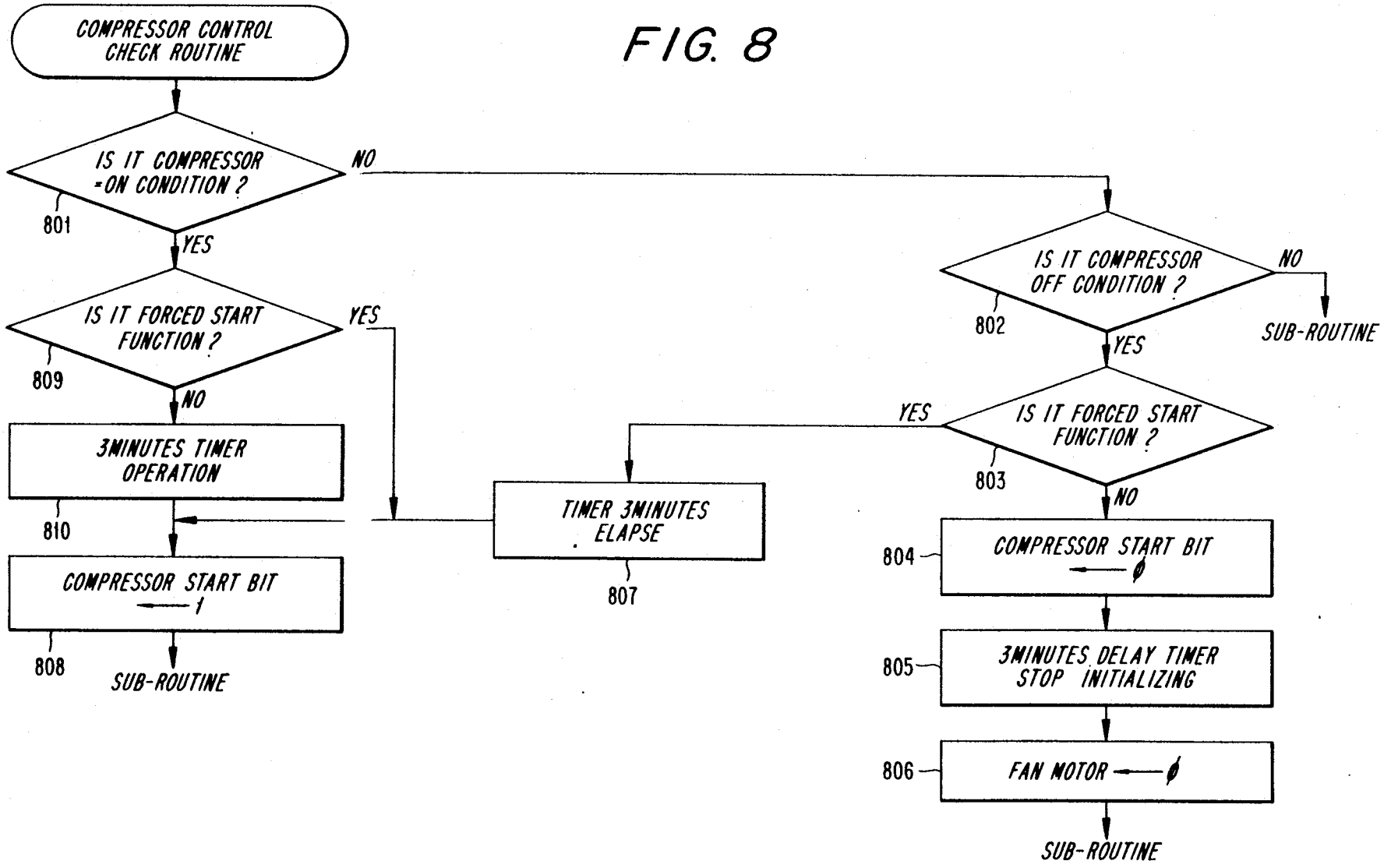
Figure 9:
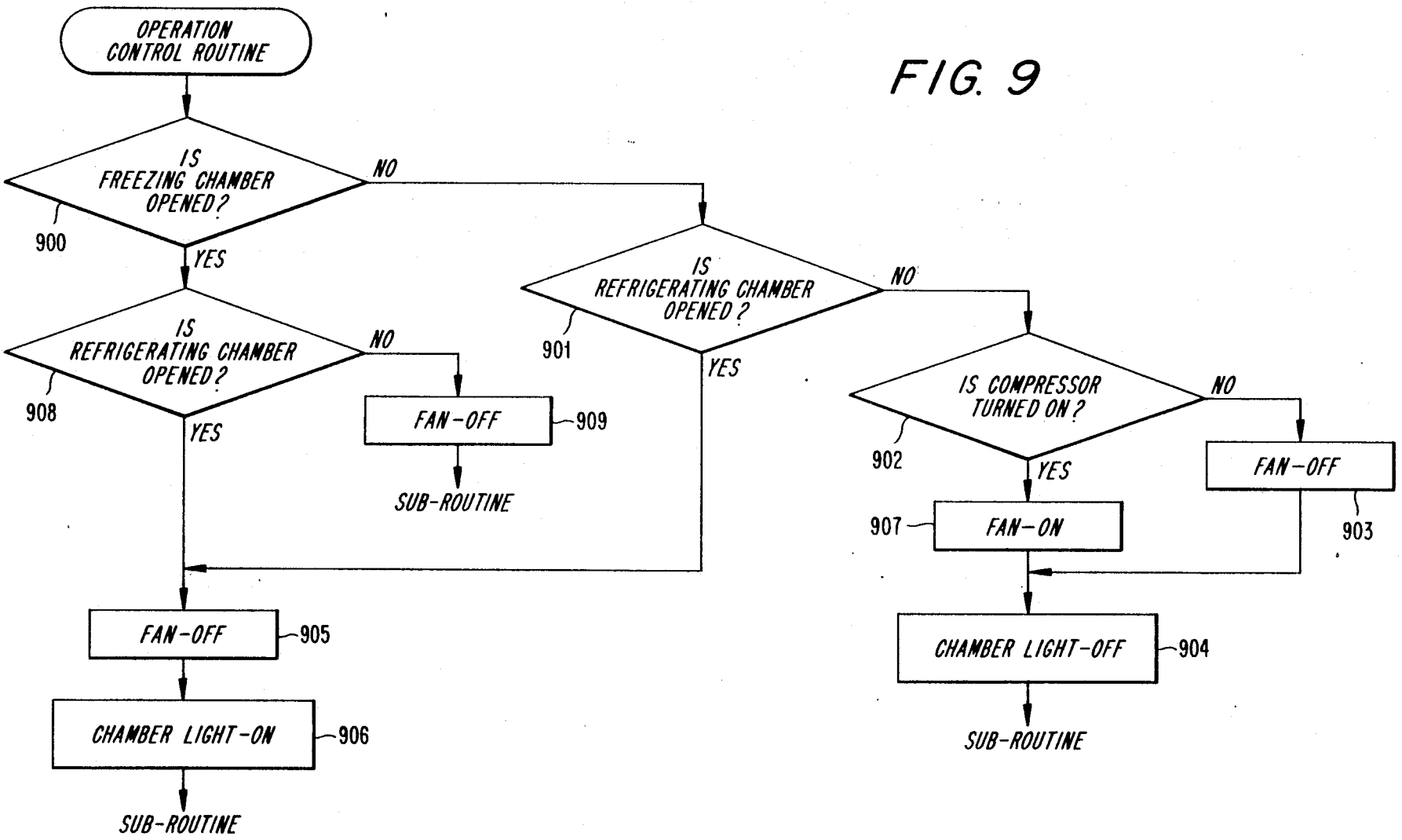
Figure 10A:
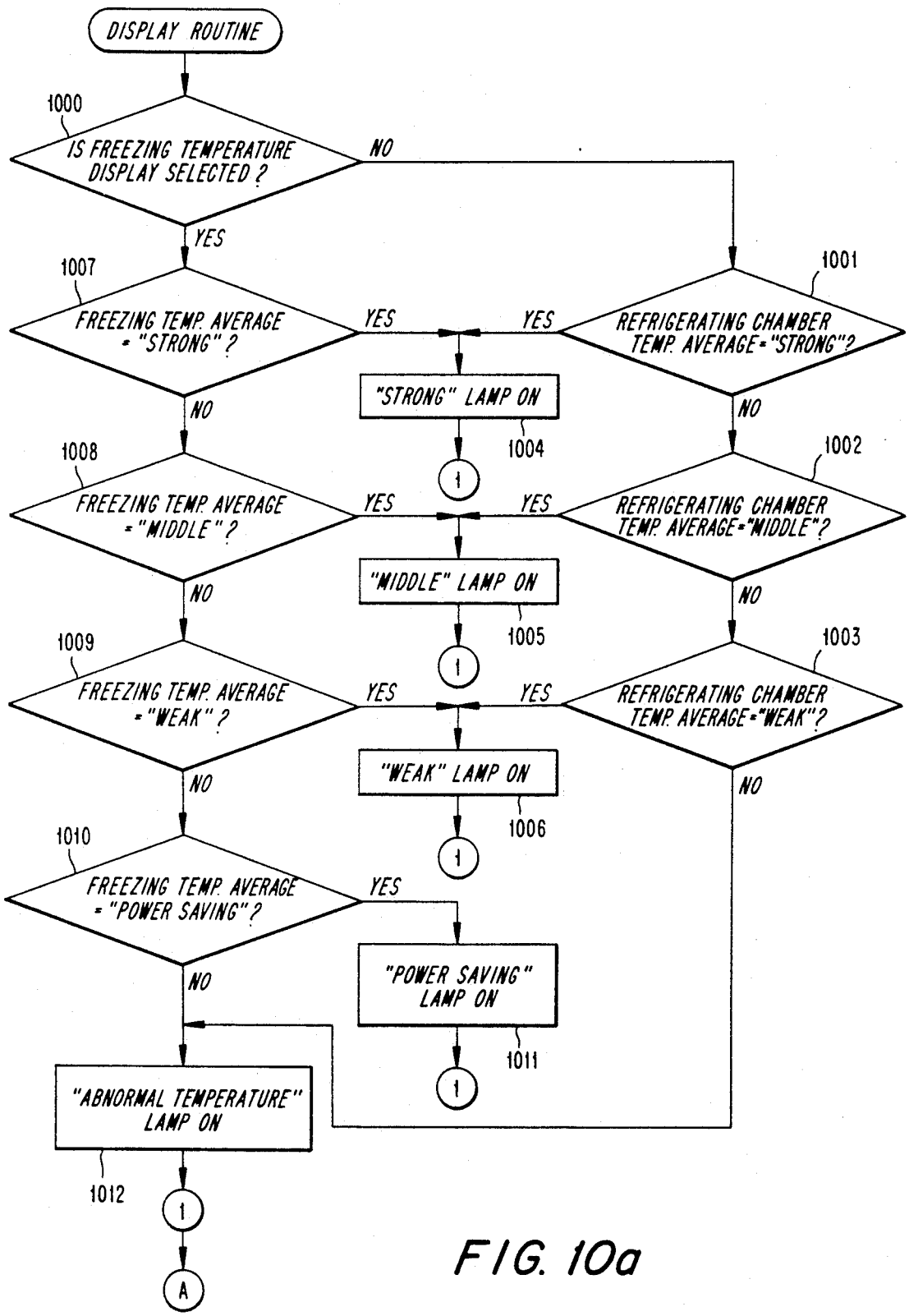
Figure 10B:
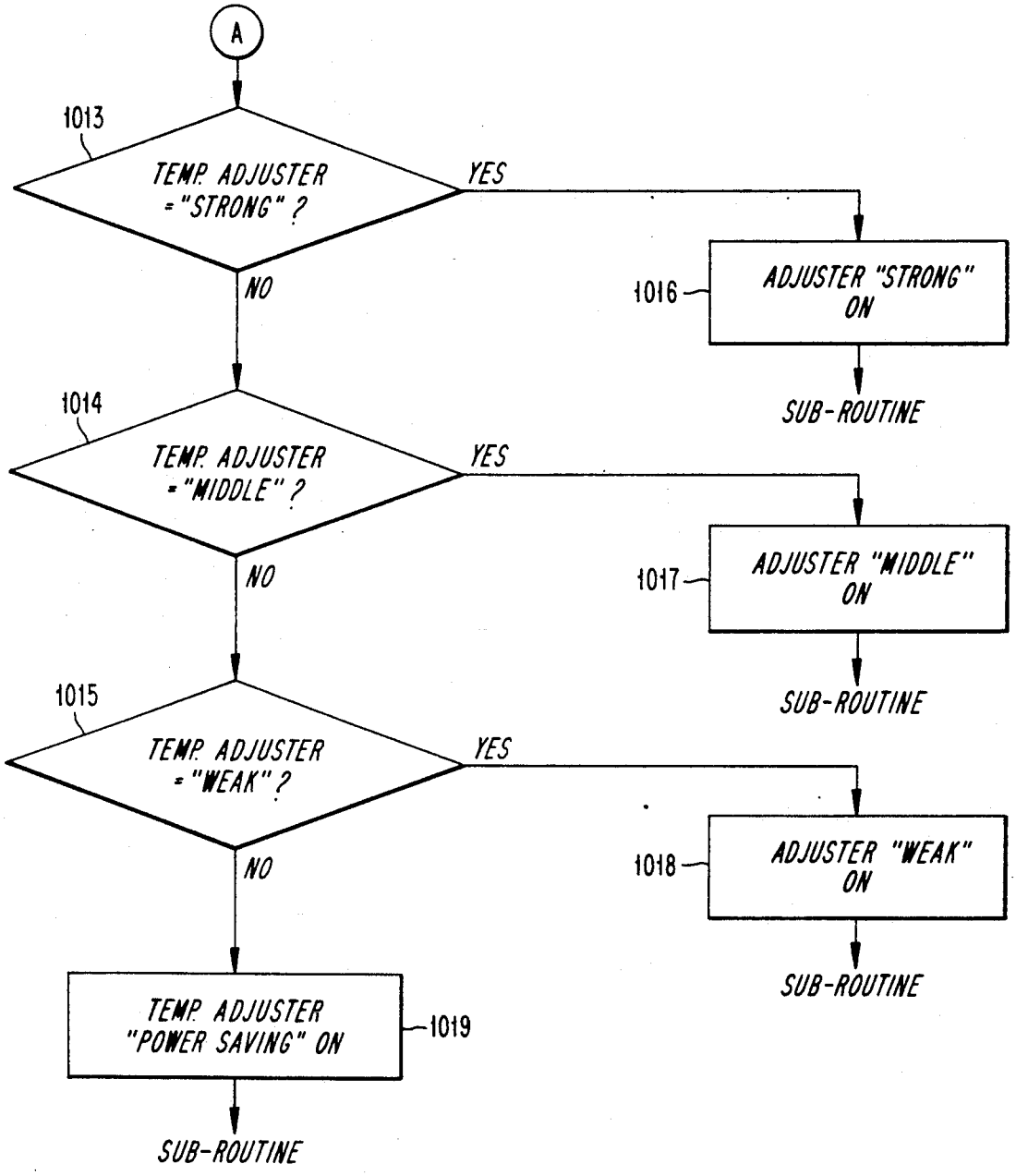
Figure 11A:
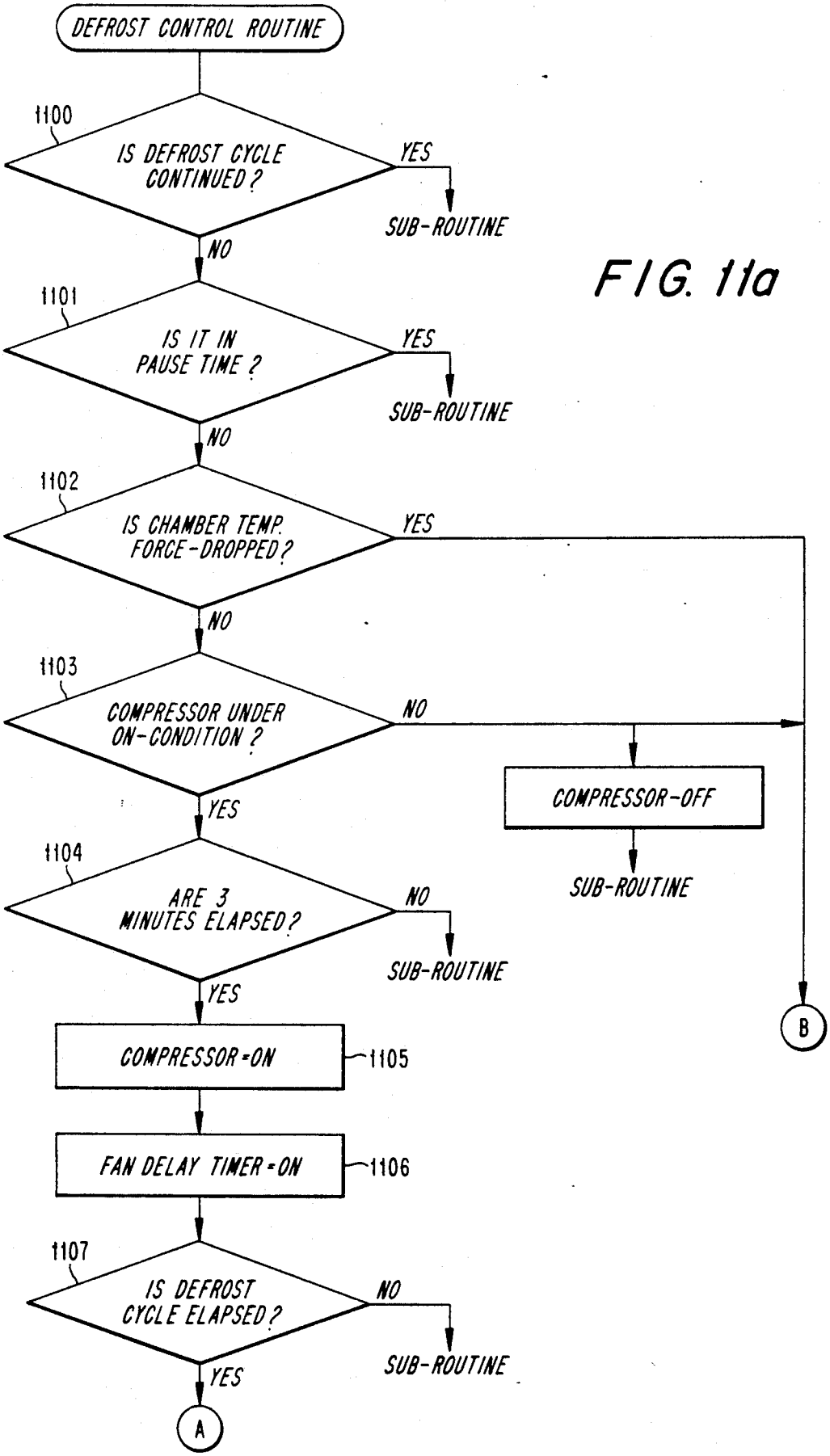
Figure 11B:
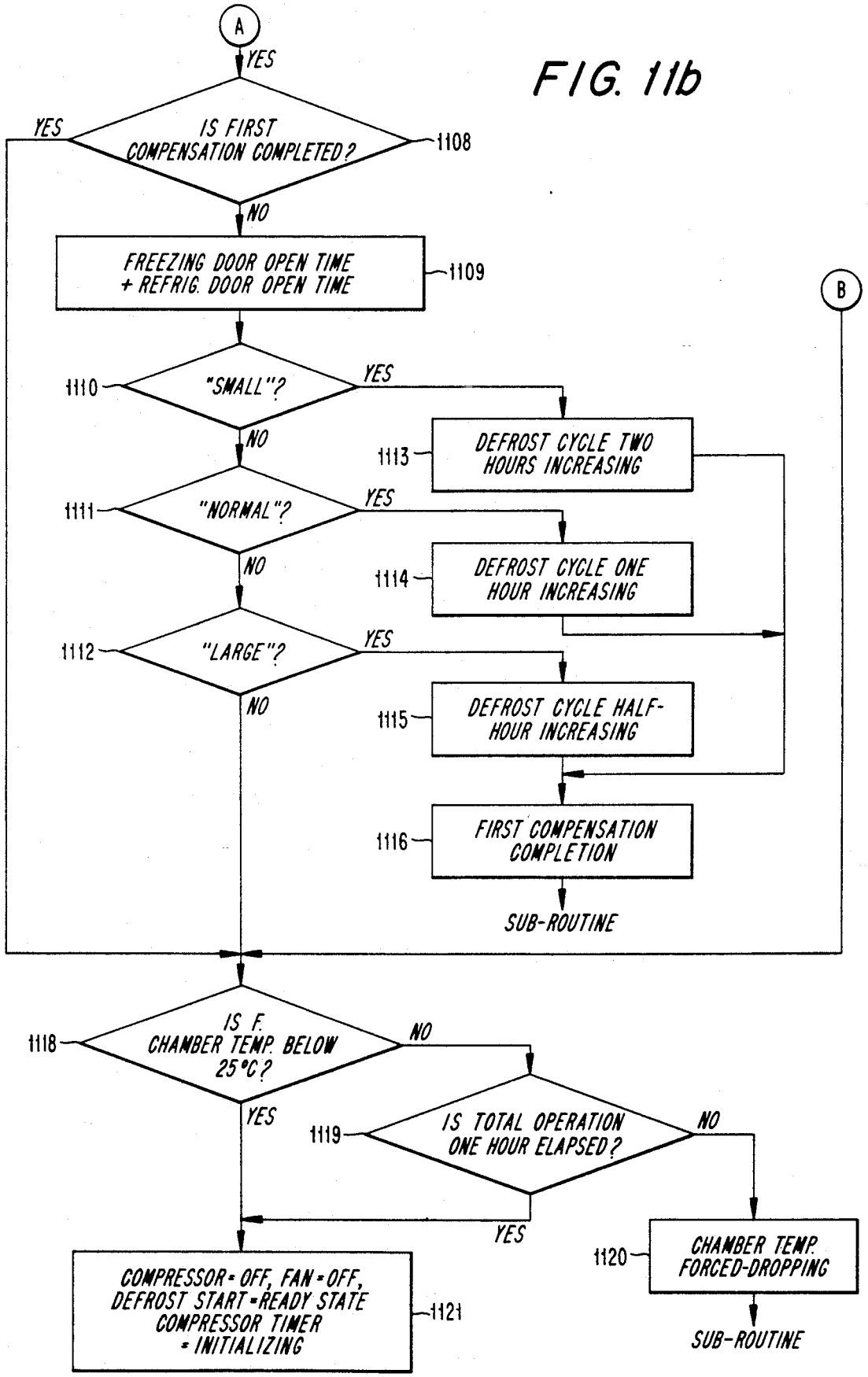
Figure 12:
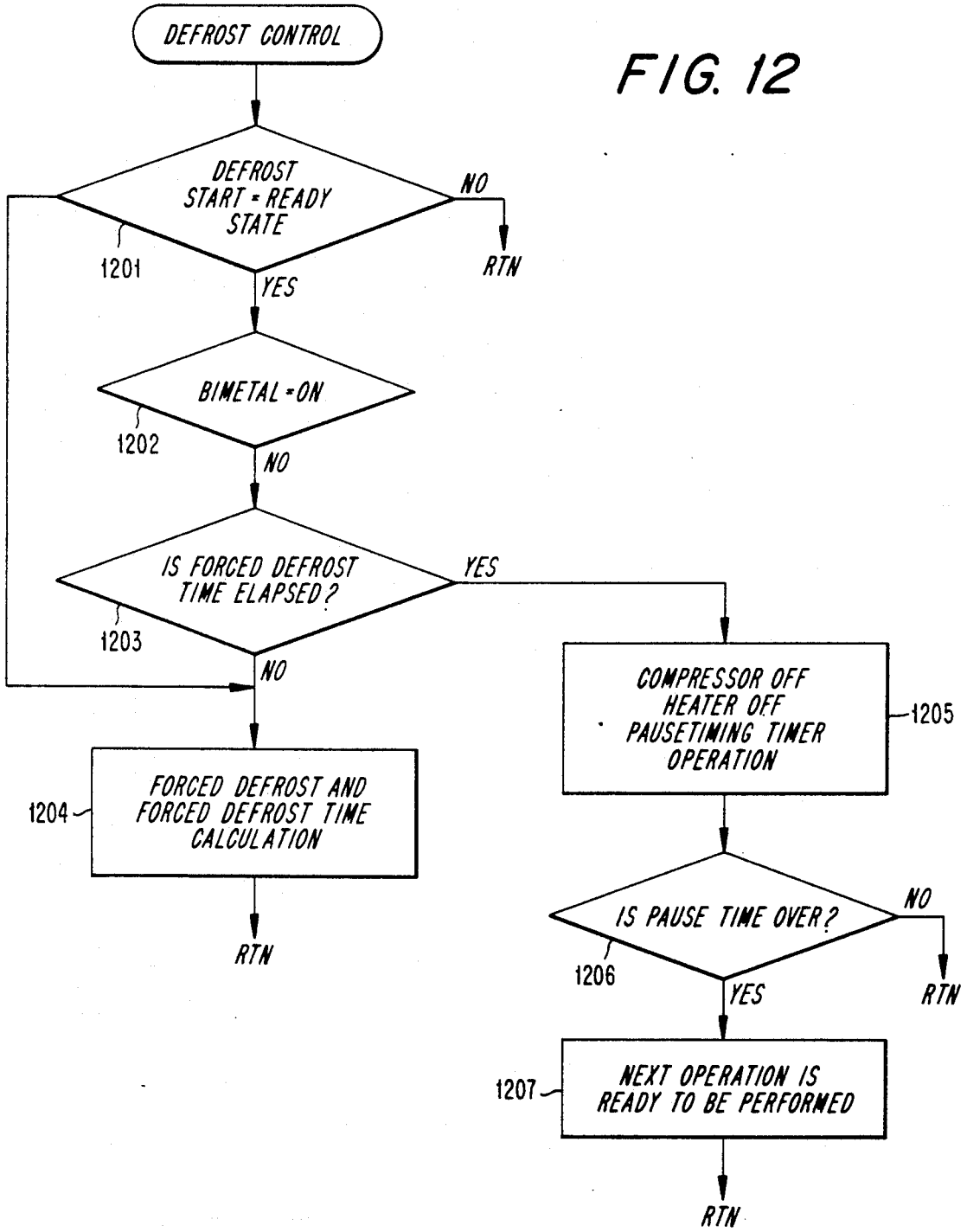

FIGS. *3a–3c* are a flow chart illustrating a key scan routine according to the present invention;

FIG. 4 is a flow chart illustrating a check routine for sensing the open/close state of freezing and refrigerating chambers according to the present invention;

FIG. 5 is a flow chart illustrating a temperature A/D converting routine for converting the values of the freezing chamber temperature refrigerating chamber temperature and the setting value of a temperature adjuster to digital signals according to the present invention;

FIG. *6a* is a flow chart illustrating at least one accumulating routine for calculating the average values of the freezing and refrigerating chamber temperatures according to the present invention;

FIG. *6b* is a flow chart illustrating another accumulating routine for measuring/calculating the open time based on the open/close state of the freezing and refrigerating chambers according to the present invention;

FIGS. *7a–7b* are a flow chart illustrating a temperature adjusting routine for controlling the chamber temperature according to the abnormality temperature based on the operation conditions and the open/close frequency of a refrigerator according to the present invention;

FIG. 8 is a flow chart illustrating a compressor control check routine according to the present invention;

FIG. 9 is a flow chart illustrating a drive control routine for controlling a fan motor and a chamber light, etc. according to the present invention;

FIGS. 10*a* and 10*b* are a flow chart illustrating a display routine adapted to the present invention;

FIGS. 11*a* and 11*b* are a flow chart illustrating a compressor control and its operating time accumulating routine according to the present invention; and FIG. 12 is a flow chart illustrating a defrost control routine according to the present invention.

DETAILED DESCRIPTION OF THE INVENTION

Figure 1:
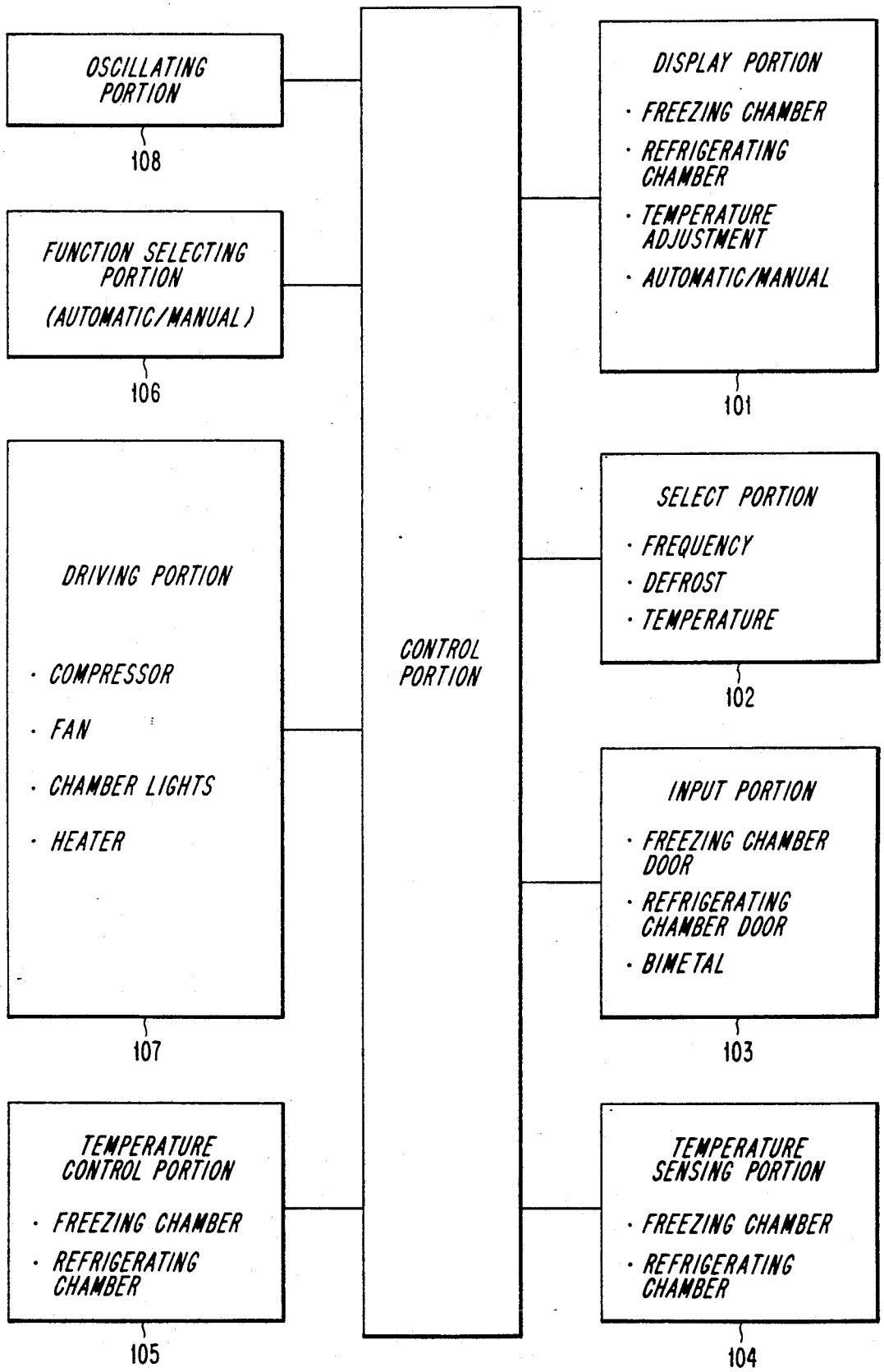
FIG. 1 is a block diagram illustrating an automatic operation control system adapted to an automatic operation control method of a refrigerator according to the present invention.

FIG. 1 illustrates an automatic operation control system of a refrigerator according to the present invention.

A control portion 100 called a microcomputer includes memories ROM and RAM and an A/D converter, etc. for processing input data and controlling all loads of a refrigerator according to the programming data previously stored.

A display portion 101 includes a chamber temperature display for selectively representing the temperatures of the freezing and refrigerating chambers, a display for showing the automatic switching position "AUTOMATIC or MANUAL" of a temperature adjuster and a function select display for representing the function state dependent upon the automatic or manual operation condition.

A select portion 102 includes selecting portions for selecting any one frequency of 50 Hz and 60 Hz necessary for a timer, for selecting a defrost cycle when a refrigerator requires a different defrost cycle, and for inputting a frequency, a defrost cycle and a temperature to again fix a temperature when a refrigerator requires a different temperature setting.

An input portion 103 includes a door open/close sensing portion for reading the door open/close frequency of freezing and refrigerating chambers and a portion for sensing the on-off state of a bimetal.

A temperature sensing portion 104 includes a temperature sensor such as a thermistor and an A/D converter to sense the temperatures of the freezing and refrigerating chambers.

A temperature control portion 105 is configured to adjust the temperatures of freezing and refrigerating chambers at the user's option.

A function selecting portion 106 permits the user to select automatic or manual operation of the refrigerator, thereby obtaining the power saving effect during automatic operation and adjusting the chamber temperature according to the user's intention.

A driving portion 107 receives the resulting data determined by the control portion 100 and then controls the compressor, the fan motor, the chamber light and the defrost heater, etc.

An oscillating portion 108 applies clock oscillating signals to the control portion 100.

The automatic operation control system is first initialized when applied to a power source. The select signals, which are associated with the automatic or manual operation of the refrigerator from the function selecting portion 106 and the auxiliary adjustment of the freezing and refrigerating chamber temperatures from the temperature control portion 105, are applied to the control portion 100. The control portion 100 processes the inputted signals to apply the control signals to the display portion 101 to display the automatic or manual operation of the refrigerator and the freezing and refrigerating chamber temperatures while scanning the door open/close frequency and open time and the bimetal on-off state or its faulty state. Further, the control portion 100 receives the scanned data from the input portion 103 and continues to sense the freezing and refrigerating chamber temperatures from the temperature control portion 105.

Thus, the control portion 100 compares/computes data from the temperature control portion 105, the input portion 103 and the temperature sensing portion 104, calculates the average value of each of the freezing and refrigerating chamber temperatures, outputs processed data to each of the display portion 106 and the driving portion 107 to operate the compressor, the fan, the heater and the chamber light based on the control selecting condition controlled by the function selecting portion 106 and the temperature control portion 105, thereby automatically controlling the chamber temperature, the power saving, and the automatic or manual operation.

Also, the select portion 102 allows the automatic operation control system to auxiliary set the use frequency, the defrost cycle and the chamber temperature according to the usage method of a refrigerator.

Figure 2:
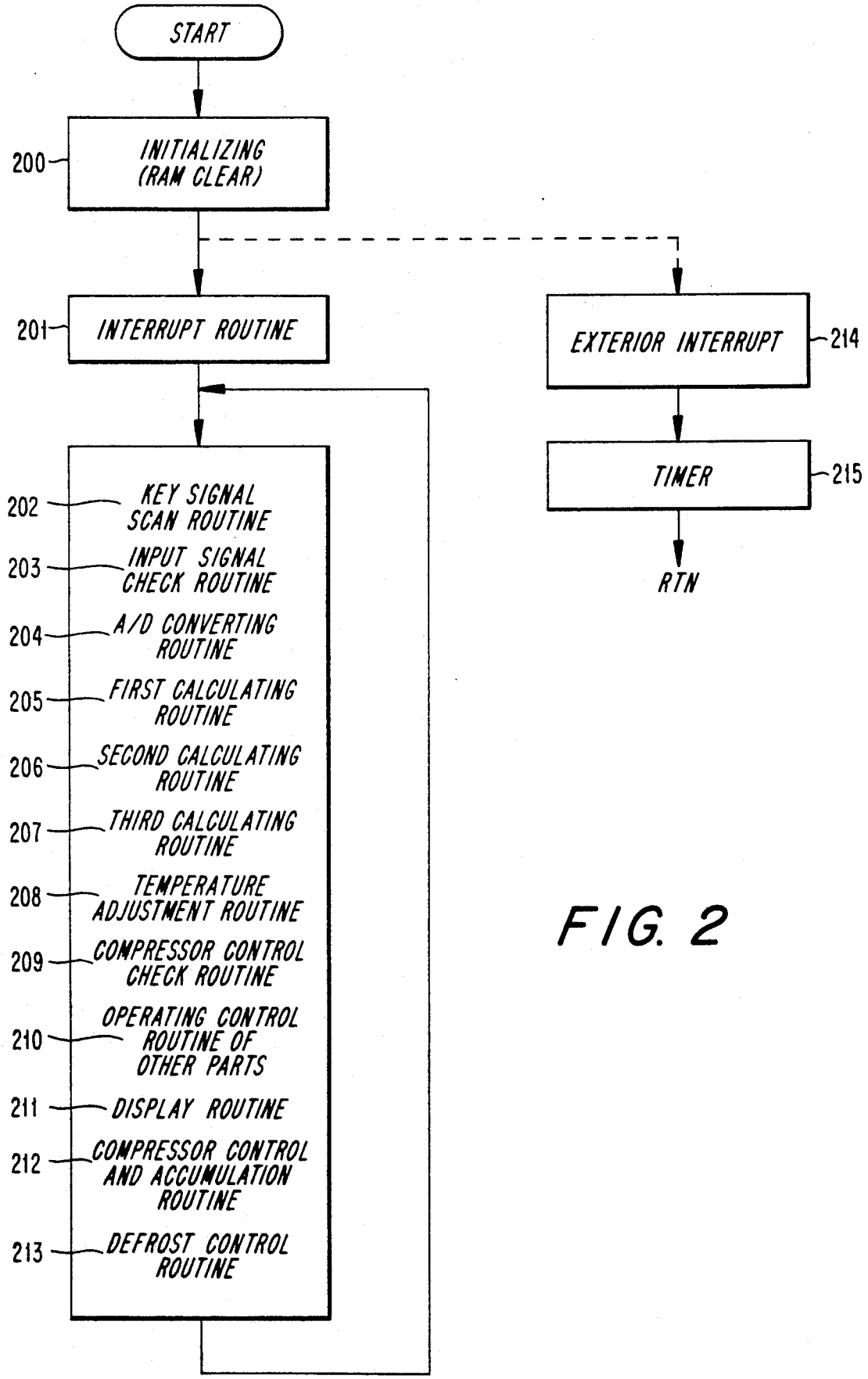
FIG. 2 is a flow chart adapted to an automatic operation control method of a refrigerator according to the present invention.

FIG. 2 illustrates a flow chart of an automatic operation control method of a refrigerator according to the present invention.

The automatic operation control method comprises an initializing routine 200 for clearing data stored in RAM of a control portion 100 when the power source is applied thereto; an interrupt routine 201 for issuing interrupt signals to the control portion 100 to perform each of sub-routines within a predetermined time according to the previously inputted programming; a key signal scan routine 202 for scanning input signals selected/sensed from a function selecting portion 107, a key input portion 103, a temperature sensing portion 104 and temperature control portion 105 during the interrupt routine; an input checking routine 203 for reading/checking key signals inputted from the key input portion 103; a temperature A/D converting routine 204 for converting the analog signals of the temperatures, sensed from the freezing and refrigerating chambers, and the temperature adjuster of the select portion 103 into digital signals; a first accumulating routine 205 for calculating the average value of the maximum and minimum values of the freezing chamber temperature; a second accumulating routine 206 for calculating the average value of the maximum and minimum values of the refrigerating chamber temperature; a third routine 207 for calculating the open/close frequency and open time of each of the freezing/refrigerating chambers and performing the automatic adjustment; a temperature adjusting routine 208 for processing the freezing chamber temperature to be forced into the refrigerating chamber temperature condition according to the determination of the temperature A/D converting routine 204, the input signal check routine 203, and the first, second and third accumulating routines 205, 206, and 207; a compressor control check routine 209 for adjusting the chamber temperature at an optimum temperature according to the result of the temperature adjusting routine and the chamber temperature difference; a driving control routine 210 for properly driving a fan motor, a chamber light and a heater according to the open/close and open time of each of the freezing and refrigerating chambers and the on-off of the compressor; a display routine 211 for representing the temperature and the temperature select conditions considered as the final results of the above routines; a routine 212 for controlling the compressor by accumulating the compressor operation time and determining whether the defrost cycle must be started based on the chamber average temperature; a routine 213 for controlling the defrost cycle; and a timer routine 215 for operating a timer based on the frequency of a power source during an exterior interrupt routine 214, in which the exterior interrupt routine 214 forces the control portion 100 to determine the power frequency of the timer.

Figure 3A:
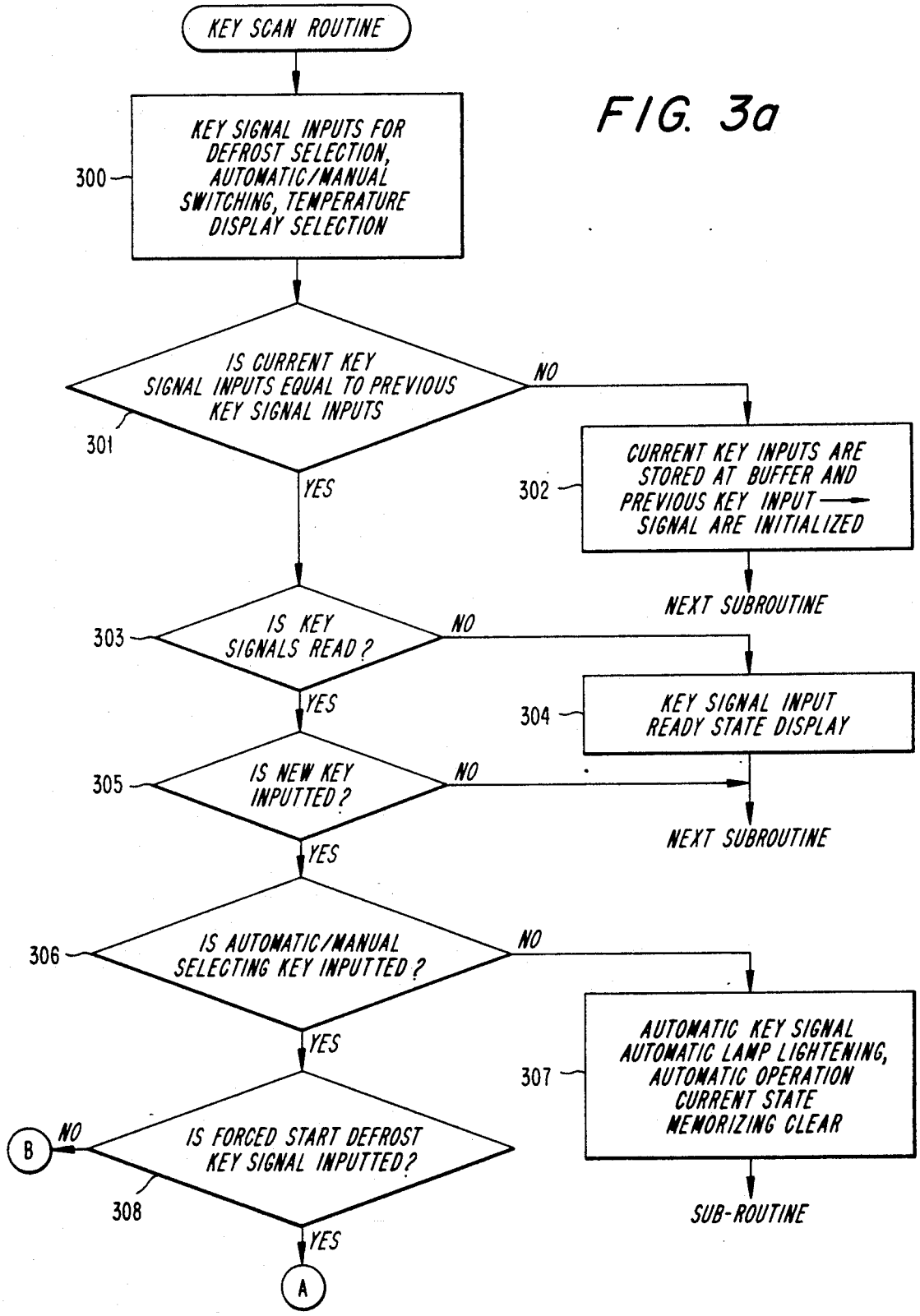
Figure 3B:
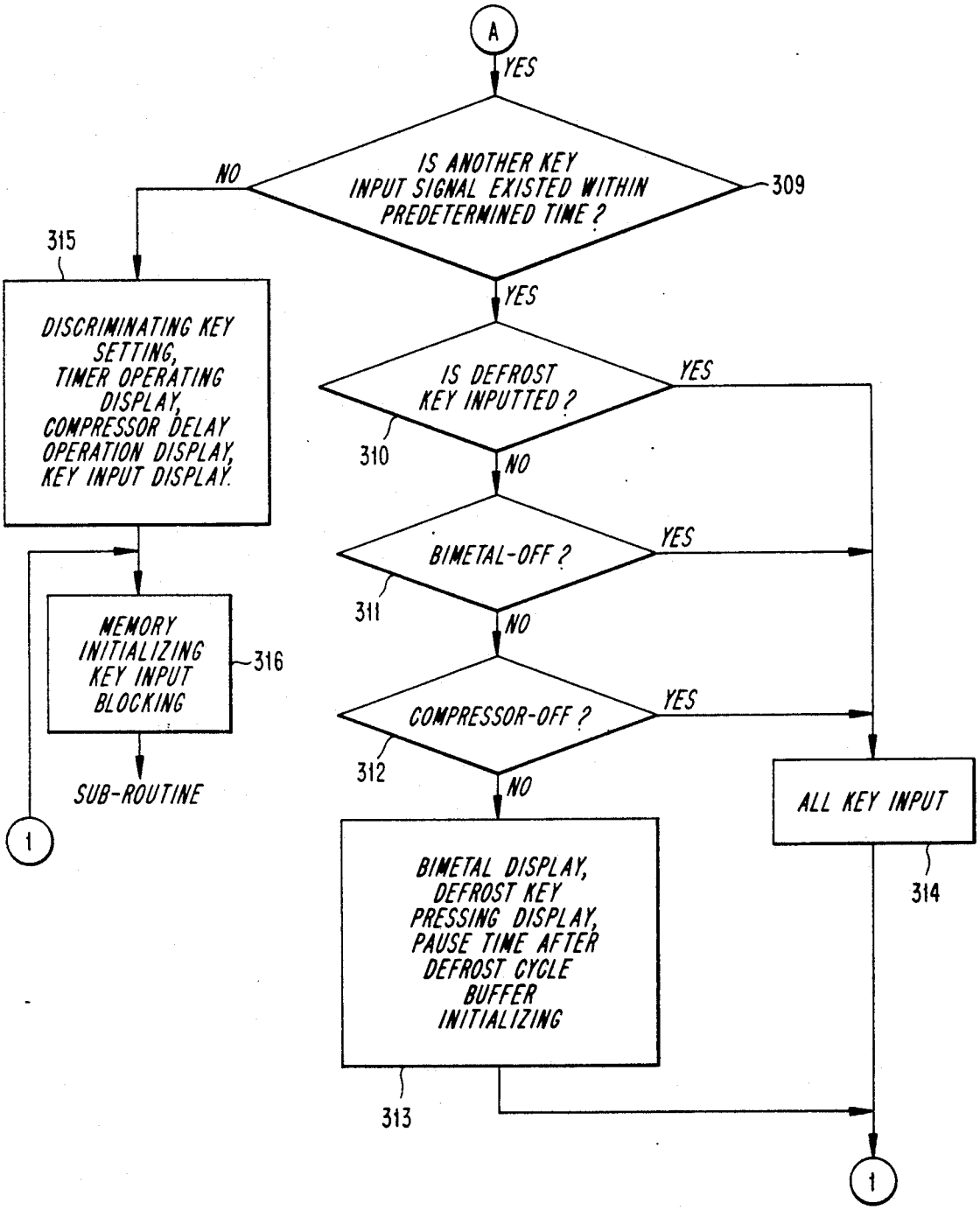
Figure 3C:
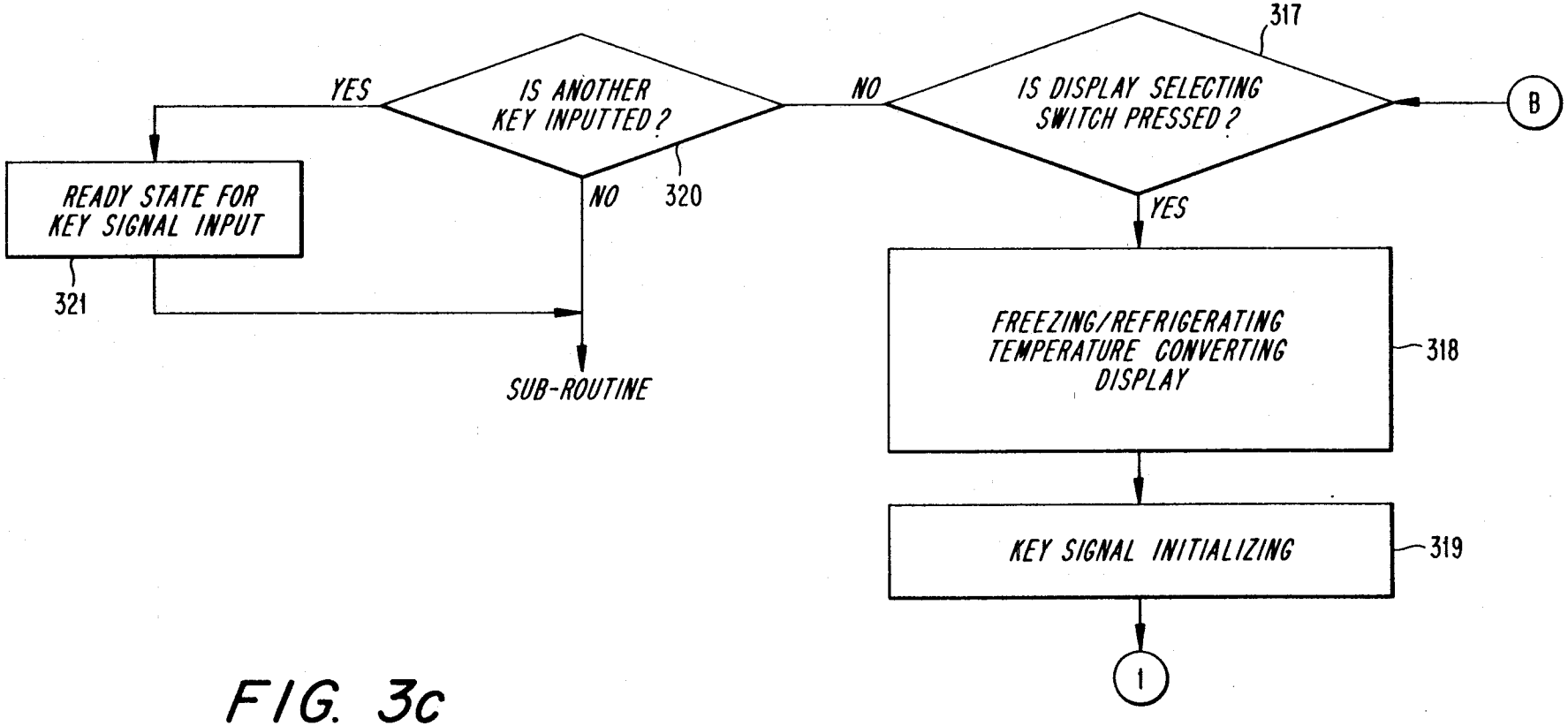

FIGS. 3*a*, 3*b*, and 3*c* are a flow chart of a key signal scan routine for reading/checking the input data to the control portion 100. The key signal scan routine 202 is associated with an automatic operation control system of FIG. 1 so that the control portion 100 receives key signal inputs from the function selection portion 106 and selects the automatic or manual function, the operation state display of the freezing or refrigerating chamber, and the forced throwing-in of the defrost cycle or the forced starting of the defrost mode without the compressor being turned off independent of the chamber temperature during the defrost cycle.

In other words, at step 300 key signals are received of the automatic/manual switching and the temperature display selection from the defrost select input portion 103, the function selecting portion 106 and the temperature control portion 105. Step 300 goes onto step 302 to compare the signals inputted from the defrost select input portion 103, the function selecting portion 106 and the temperature control portion 105 with the previous stored key signal data. If the inputting signal data is not equal to the previous data, step 301 moves onto step 302 to store the current data at the memory and then initialize the previous data to perform the next subroutine by the interrupt signal at step 304.

If the input signal data is equal to the previous data, step 301 jumps onto step 303 to determine whether the key signals are read. If the key signals are illegible, at step 304 they are processed to be read and then the next subroutine is performed. Otherwise, step 303 goes onto step 305 to determine whether the new key signals exist and performs the next subroutine, if not. If the new key signals, step 305 moves on to step 306 to determine whether the key input signal is the automatic or manual key input signal. If it is the automatic select input, at step 307 the lamp of the display portion 101 is lit and the current state of the automatic operation is cleared and the next subroutine is performed. If it is the manual select input, step 306 proceeds onto step 308 to determine whether the forced starting/defrost key signal is inputted. If the forced starting/defrost key signal is not inputted, at step 317 it is determined whether the display select switch is pressed.

If the forced starting/defrost key signal is inputted at step 308, the timer routine 215 is performed to operate the timer, while step 308 proceeds onto step 309 to determine whether another key input signal is inputted within a predetermined time, for example 3 seconds. If not, step 309 jumps to 315 to display the determined key setting, the timer display, the compressor delay operation display and the key input display. Step 315 moves on to 316 to initialize the memory and block the key input, and then perform the next subroutine. Step 309 goes on to step 310 to determine whether the defrost key input exists. If it exists, step 309 jumps to 314 to clear all key inputs. If it does not (exist) at step 310, step 310 goes on to 311 to determine whether the bimetal is turned off. If off, at step 314 all key inputs are initialized. If on, step 311 goes on to step 312 to determine whether the compressor is turned off. If the compressor is turned on, step 312 moves on to step 313 to display the normal state of the bimetal and the pressing state of the defrost key and to initialize the pause buffers after the defrost cycling and perform the next subroutine.

If the forced starting/defrost key input does not exist at step 308, step 308 jumps to step 317 to determine whether the display select switch is pressed. At that time, if pressed, step 317 moves to step 318 to determine whether the refrigerating chamber temperature is set. If set, at step 318 the temperature values of the freezing and refrigerating chamber are converted into digital data from analog data to display the temperature of each of the chambers, and then at 319 all key inputs are initialized to perform the next subroutine. On the other hand, if the display switch is not pressed at step 317, step 317 jumps to step 320 to determine whether another key is pressed. If another key is pressed, at step 320 the next subroutine is performed. Otherwise, step 320 moves on to step 321 to read the key input.

As described above, step 309 to step 314 are a diagnostic method for checking the normal operation of the refrigerator by using the forced starting/defrost key. The key signal scan routine lets the user know whether the normal operation of a refrigerator is executed.

FIG. 4 is a flow chart for checking the door switching state of the freezing and refrigerating chambers and the open/close state of the bimetal.

The control portion receives the signals of a freezing door switch, a refrigerating door switch and a bimetal switch from the input portion 103 at step 401. Step 401 moves on to step 402 to determine whether the input signals are new signals or signals of the previous state. If new signals do not exist, step 402 goes on to step 403 to store the new signals in the memory and to perform the next subroutine. If new signals exist, step 402 jumps to step 404 to determine whether the input signals are initialized after a predetermined delay time. Thereafter, at step 405 it is determined whether the switch signals are readable. If these are not readable, step 405 goes onto step 406 to determine whether the new switch signals are equal to the key input signals. If equal, the next subroutine is performed. If not equal, at step 407, the input switch signal is read and the next subroutine is executed.

On the other hand, if the switch signals are readable at step 405, step jumps to step 408 to store the new switch signals in the buffers. Step 408 goes to step 409 to initialize the buffers and perform the next routine.

Therefore, the control portion 100 is prepared to accumulate the door open/close frequency and open time and execute the temperature sensing.

FIG. 5 is an A/D converting routine for reading the values of the freezing and refrigerating chamber temperatures and converting for them into digital data. The routine permits the temperature change to be delayed for a predetermined time period, because the chamber temperature has changed less according to an amount of the stored food but the temperature change has not almost occurred at the time cycle for logging.

The A/D converting routine comprises a time delay step 501 for performing the proper logging and A/D converting at the temperature change time, a first A/D converting step 502 of converting the freezing chamber temperature from the temperature control portion 105 into the digital signals and a second A/D converting step 503 of converting the refrigerating chamber temperature from the temperature control portion 105 into the digital signals.

Figure 6A:
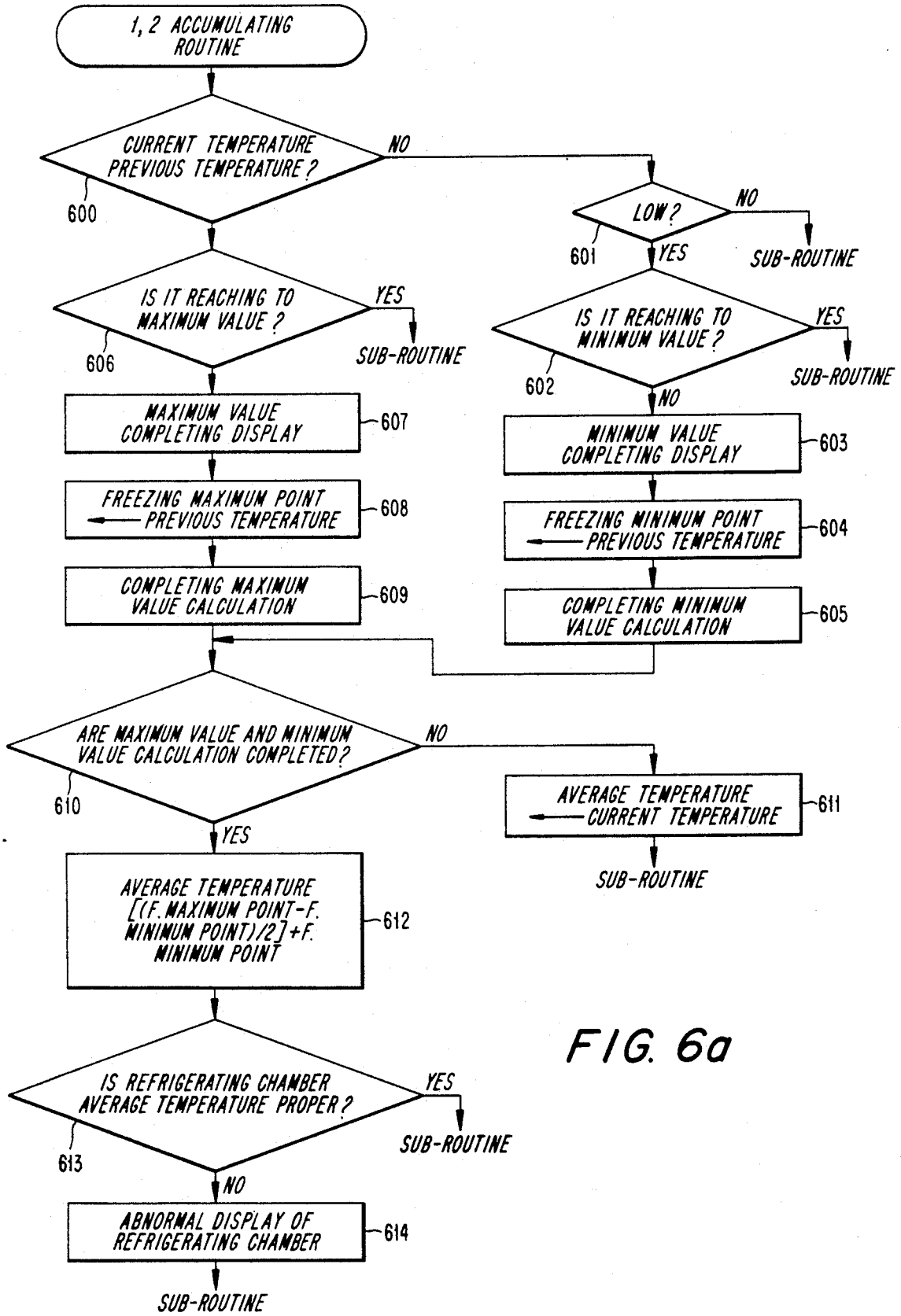

FIG. 6*a* is a flow chart for calculating the average values of the freezing and refrigerating chamber temperatures, the first and second accumulating routine.

The chamber load temperature is actually adjusted to maintain the average value of the actual temperatures according to the on-off state of the compressor and the usage frequency of the refrigerator. The routine comprises steps of calculating the maximum and minimum points of the temperature from the temperature sensing portion 104, calculating the average value of these two values to use as data of the display and the other control device, displaying the actual chamber temperature and properly acting against the operation situation of the refrigerator.

The freezing chamber temperature is sensed by the sensor of the temperature sensing portion 104 during the first operation. The sensed temperature is inputted through an A/D converting routine as described below to the control portion 100.

Thus, the control portion 100 determines whether the current refrigerating chamber sensed through the A/D converting routine is higher than the previous temperature. If not, at step 601 it is determined whether the current temperature is lower than the previous temperature. If the current temperature is higher than the previous temperature, the next subroutine is executed. Otherwise, step 601 goes on to step 602 to check the lowest temperature. The completion of the minimum temperature check is introduced in step 603 to display it, and in the case of the incompletion of the minimum temperature check, the next routine is performed. Thereafter, at step 604 the previous temperature is stored in the memory and is considered as the minimum point of the freezing chamber temperature. The minimum value calculation is completed at step 605.

If the current temperature is higher than the previous temperature at step 600, step 600 jumps to step 606 to determine whether the maximum temperature check is completed. The completion of the maximum temperature check leads to performing the next subroutine. In the case of the incompletion of the maximum temperature check, the maximum temperature sensing state is displayed at step 607. Next, at step 608 the previous temperature is stored in the memory and is considered as the maximum point of the freezing chamber temperature. The maximum value calculation is finished at step 609. Then, at step 610 it is determined whether the maximum and minimum temperature value calculation is completed. The incompletion of the maximum and minimum temperature value calculation leads to step 611 of storing the current temperature as the average temperature in the memory and then executing the next subroutine. The completion of the maximum and minimum temperature value calculation leads to step 612 of storing the value in memory, obtained through the steps of subtracting the minimum point of the freezing chamber temperature from the maximum point of the freezing chamber, dividing that value by two and adding to the minimum point, as the average value. Therefore, the temperature adjustment of the freezing chamber is ended to perform the next subroutine. Next, step 612 goes on step 613 to determine whether the average temperature is suitable for the refrigerating chamber. If it is suitable, the next subroutine is performed. If not, step 613 moves on to step 614 to display the abnormal state of the refrigerating chamber, and the current accumulating routine is again performed associating with the refrigerating chamber.

FIG. 6*b* is a flow chart for measuring/calculating the open time according to the door open/close state of the freezing and refrigerating chamber; a third accumulating routine.

The routine first checks the elapse of the balancing time that the doors must be closed after an opening time period, when the freezing and refrigerating chamber doors are opened for more than a predetermined time period. If the balancing time elapses, the door open/-close operation is supposed not to occur and the temperature increase condition is displayed. If at least two door open/close operations are performed within the balancing time, the chamber temperature is dropped. If the door is opened only once, the chamber temperature is maintained at the current temperature.

Therefore, the routine enables not only the chamber temperature to be maintained at the optimum state, but also the temperature adjuster to be automatically switched according to the usage frequency of a refrigerator, thereby reducing the electrical power consumption.

The control portion 100 first determines dependent upon the signal from the input portion 103, whether the freezing chamber door is opened at step 620. If opened, the open close time is cleared at step 621 and then the door open time is measured at step 622 to perform the next subroutine. If the door is not (open), step 620 jumps to step 623 to measure the door close time. Step 623 moves to step 624 to check the elapse of the balancing time. If the balancing time has elapsed, step 625 of initializing the door open time, step 626 of displaying the temperature increase condition and step 626 of clearing the first check completion is in turn executed to return to the next subroutine.

If the balancing time has not elapsed, step 624 jumps onto step 628 to determine whether the first check is completed. If completed, step 628 moves to step 629 to determine whether the door open/close operation is performed. If not performed, it is returned to step 624 to determine whether the balance time is elapsed. If the door open/close operation is performed, the next subroutine is performed through step 630 of displaying the temperature dropping condition.

On the other hand, if the first check is not completed, step 628 jumps to step 631 to determine whether the freezing door is opened. If not opened, the next subroutine is executed through step 632 of displaying the temperature maintaining state. If opened, step 633 and step 634 of displaying the first check completion and the temperature maintaining state are in turn performed and then returned to the next subroutine.

Figure 7A:
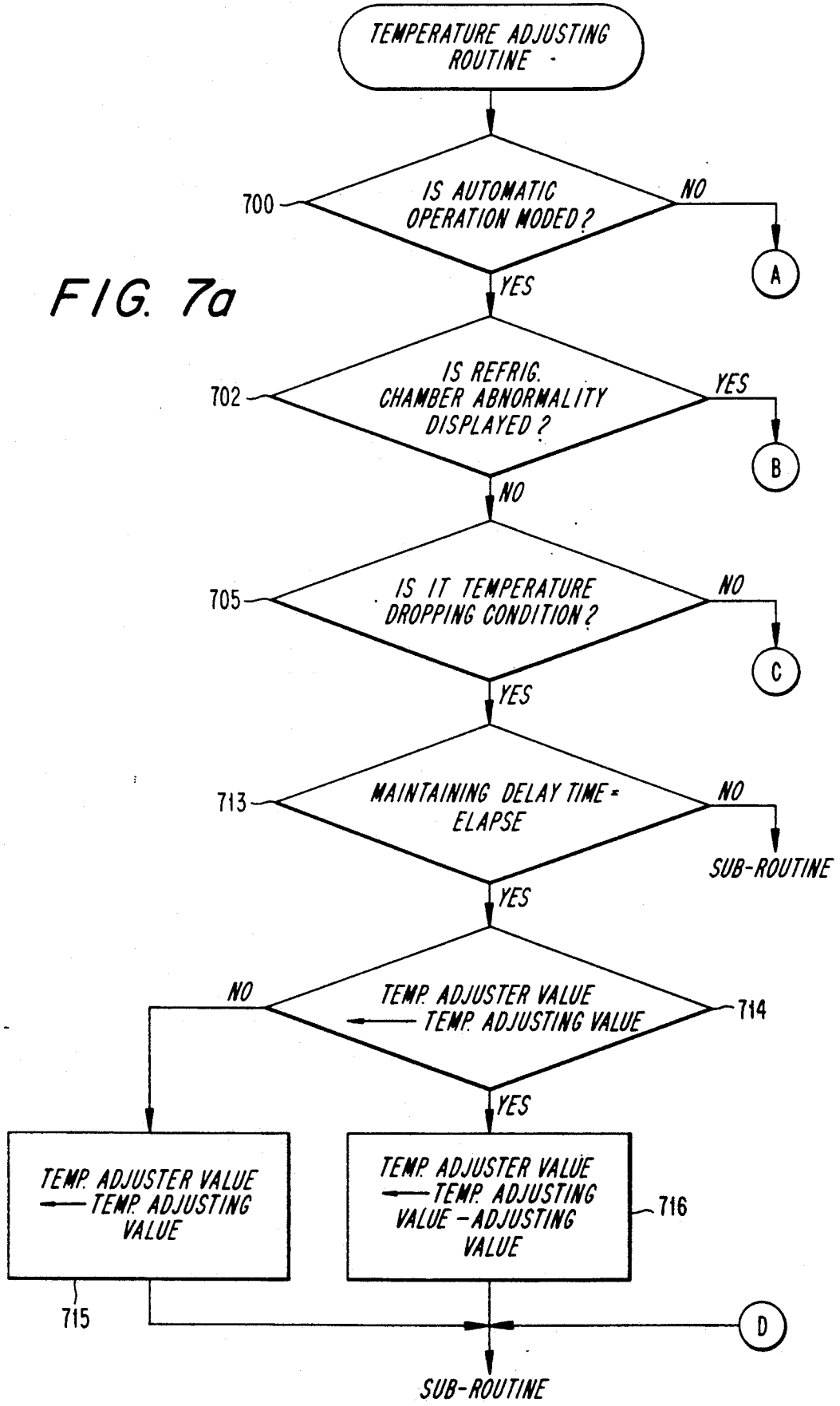
Figure 7B:
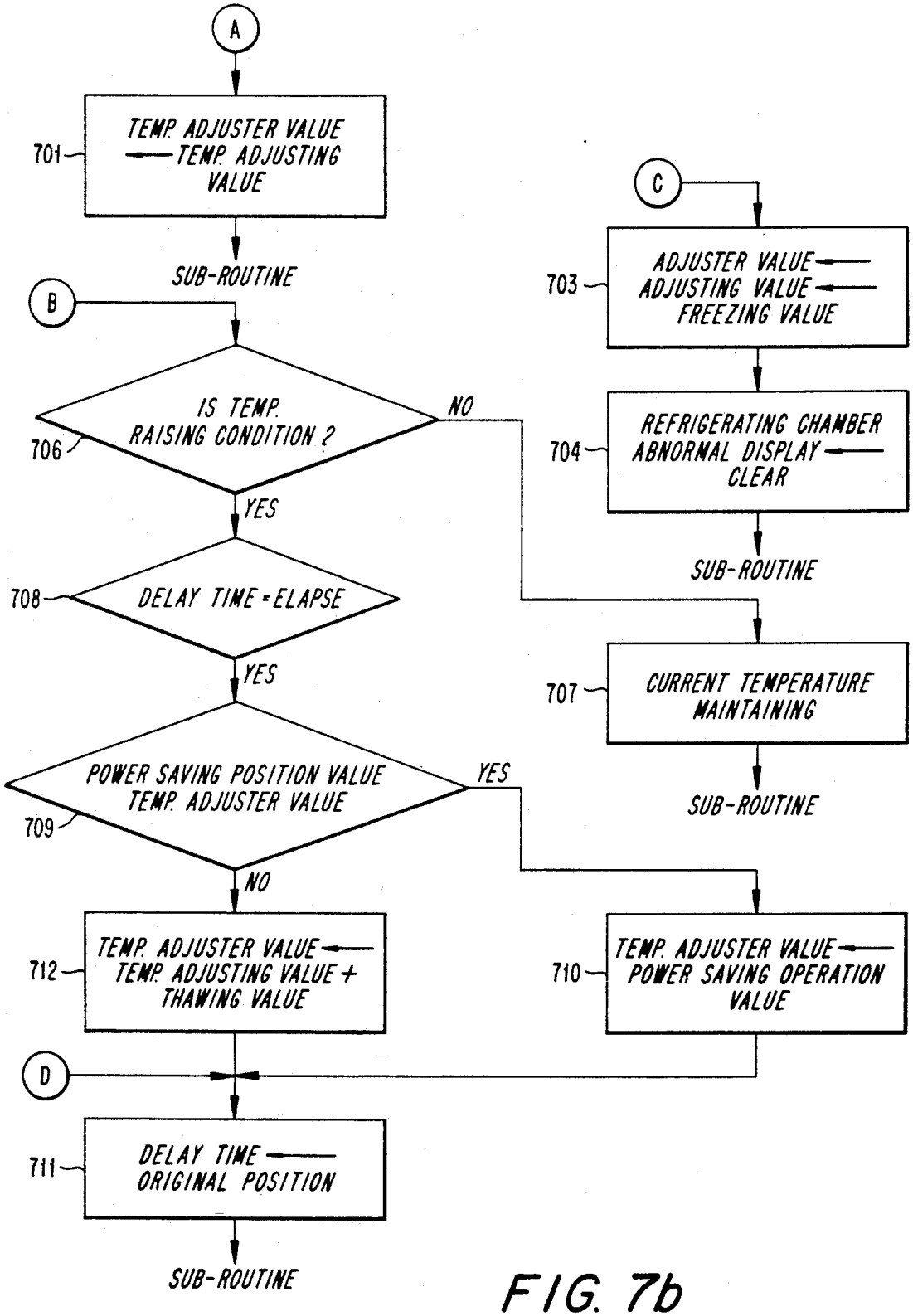

FIGS. 7*a* and 7*b* are a flow chart of a temperature adjusting routine according to the operation condition, the door open/close state and the normal or abnormal state of the refrigerating chamber.

Based on the door state from the input portion 103, the temperature state sensed by the temperature sensing portion 104, and the temperature adjusting state dependent upon the automatic or manual operation selected by the function selecting portion 106, the refrigerator is controlled. In other words, when the refrigerator is operated at the manual state, the previous stored data is stored in RAM according to the selecting position of the temperature adjuster. During the automatic operation, if the refrigerating chamber is under the abnormal temperature condition according to the determination of whether the refrigerating chamber temperature is increased over a predetermined value, the current temperature adjusting value is subtracted by a predetermined value and stored in the memory and the abnormal temperature display of the refrigerating chamber. On the contrary, if the refrigerating chamber is cleared is not under the abnormal condition, the refrigerating chamber abnormality is processed according to the result of the temperature increasing or dropping condition.

At step 700 it is determined whether the automatic mode is operated. If the operation is not the automatic mode, the temperature adjusting value is stored in the temperature adjuster at step 701 to perform the next subroutine. If the operation is (the) automatic mode, step 700 moves to step 702 to determine whether the refrigerating chamber abnormality is displayed. If the abnormality is displayed, steps 703, 704 and 705 of subtracting the freezing temperature value from the temperature adjusting value, storing the difference value in the temperature adjuster and clearing the refrigerating chamber abnormality display are then performed and then returned to the next subroutine.

On the other hand, if the abnormality state does not exist, step 702 moves to step 705 to determine whether the temperature has dropped. If the temperature dropping condition is not in effect, at step 706 it is determined whether the chamber temperature is increased. If it the temperature increasing condition is not in effect, step 707 of maintaining the current temperature is performed and control returns to the next subroutine. Under the temperature increasing condition, step 706 goes to step 708 to determine whether the maintaining delay time has elapsed. If elapsed, step 708 moves to step 709 to determine whether the power saving operation position value exceeds the temperature adjusting value. If the power saving operation position value is higher than the temperature adjusting value, step 710 of storing the power saving operation value as the maintaining delay time in the memory is performed and control returns to the next subroutine. But, if the power saving operation position value is below the temperature adjusting value, step 709 moves to step 712 to add the thawing temperature value to the temperature adjusting value, storing that value in the memory. Thereafter, the next subroutine is performed after step 711 of clearing the maintain delay time.

Under the temperature dropping condition, step 705 proceeds to step 713 to determine whether the maintaining delay time has elapsed. If the delay time has not (elapsed), the next subroutine is executed. If the delay time has elapsed, at step 714 it is determined whether the temperature adjuster value is smaller than the temperature adjusting value. If the temperature adjuster value is higher than the temperature adjusting value, the temperature adjusting value is stored in the temperature adjuster, and then the next subroutine is performed. On the contrary, if the temperature adjuster value is smaller than the temperature adjusting value, step 716 of subtracting the freezing temperature value from the temperature adjusting value and storing the value in the temperature adjuster and step 711 are in turn performed to return to the next subroutine. The reason for determining the elapse of the maintaining delay time is to maintain the chamber at the temperature adjusted state for a predetermined time period, thereby minimizing the temperature change of the chamber.

FIG. 8 is a flow chart of a compressor control check routine for controlling the chamber temperature of a refrigerator at the optimum state. The routine controls the chamber temperature according to the result of the temperature adjusting routine and the temperature differences between the chambers.

At step 801 it is determined whether the compressor is under the on-condition. If the compressor is not under the on-condition, at step 802 it is determined whether the compressor is under the off-condition. Under the on-condition, the next subroutine is performed. Under the off-condition, step 802 moves to step 803 to determine whether the forced starting function is selected.

If the forced starting function is not selected at step 803, steps 804, 805 and 806 of clearing the starting bit of the compressor, initializing the timer to delay three minutes and initializing the fan motor are in turn performed. Then the next subroutine is performed.

If the forced starting function is selected at step 803, steps 807 and 808 of forcing the timer to delay the operation of the compressor by three minutes and starting the operation of the compressor are performed to return to the next subroutine.

If the compressor is under the on-condition, step 801 jumps to step 809 to determine whether the forced starting function is selected. If the forced starting function is selected, step 809 moves onto step 808 to set the compressor starting bit 1 and then start the operation of the compressor to return to the next subroutine. Otherwise, if the forced starting function is not selected, steps 810 and 808 of operating the three delay timer, setting the compressor starting bit to 1 and then starting the operation of the compressor are executed, and the next subroutine is performed. Thus, the restraining of the unnecessary compressor operation reduces the power consumption.

FIG. 9 is a flow chart of a drive control routine for properly controlling the fan, the chamber light and the heater according to the door open/close frequency of each of the chambers and the on-off of the compressor.

The control portion 100 first determines whether the freezing chamber door is opened at step 900. Step 900 moves to step 901 to determine whether the refrigerating chamber door is opened.

If the refrigerating chamber door is opened at step 901, steps 905 and 906 of turning off the fan motor and turning on the chamber light are in turn performed to return to the next subroutine.

If the refrigerating chamber door is closed, step 901 moves onto step 902 to determine whether the compressor is turned on. If the compressor is turned on, steps 903 and 904 of turning on the fan motor and turning off the chamber light are in turn performed to return to the next subroutine.

On the other hand, if the freezing chamber door is opened at step 900. Step 900 moves onto step 908 to determine whether the refrigerating chamber door is opened. If the refrigerating chamber door is not opened at step 908, steps 909 of turning off the fan motor to return to the next subroutine.

If the refrigerating chamber door is opened at step 908, steps 905 and 906 of turning off the fan motor and turning on the chamber light are in turn performed to return to the next subroutine.

It is noted that the fan motor and the chamber lighter are controlled at the optimum state according to the current state of the compressor and the freezing and refrigerating chamber.

FIGS. 10*a* and 10*b* are a flow chart of a display routine for displaying the resulting temperature to be adjusted and the temperature selecting condition.

The control portion 100 first determines whether the freezing chamber temperature display is selected. If the display is not selected, steps 1001, 1002 and 1003 of determining whether the refrigerating chamber average temperature is any one of "STRONG", "MIDDLE", and "WEAK" are in turn performed. Then, according to each of the determined results, the corresponding lamp is respectively lit through steps 1004, 1005 and 1006.

If the freezing chamber temperature display is selected, steps 1007, 1008, 1009 and 1010 of determing whether the freezing chamber average temperature is any one of "STRONG", "MIDDLE", "WEAK", and "POWER SAVING" are in turn performed. Then, according to each of the determined results, the corresponding lamp is respectively lit through steps 1004, 1005, 1006 and 1010.

If the refrigerating chamber average temperature is not any one of "STRONG", "MIDDLE", and "WEAK", and also the freezing chamber average temperatures is not the power saving mode, at step 1012 the abnormal temperature lamp is turned on. Next, step 1012 passes through steps 1013, 1014 and 1015 in turn to determine whether the state of the temperature adjuster is any one of "STRONG", "MIDDLE", and "WEAK". According to each of the determined results, the corresponding adjuster lamp is respectively turned on through steps 1016, 1017 and 1018. Thereafter, if the temperature adjuster is not adjusted at the weak mode, step 1015 moves to step 1019 to operate the temperature adjuster at the power saving mode and then return to the next subroutine.

FIGS. 11*a* and 11*b* are a flow chart of a compressor control and its operating time accumulating routine for determining the defrost throwing-in based on the chamber temperature sensed.

The control portion 100 first determines whether the defrost cycling is performed. If the defrost cycling is performed, the next subroutine is executed. If the defrost cycling is not performed, step 1100 moves onto step 1101 to determine whether the defrost cycling is paused. If the defrost cycling is paused, the next subroutine is performed. If the defrost cycling is not paused, step 1102 goes to step 1103 to determine whether the freezing chamber temperature is forcibly decreased.

At that time, under the chamber temperature dropping condition, step 1102 jumps to step 1118 to determine whether the freezing chamber temperature is equal to −25° C. If not, at step 1119 it is determined whether the total operation time of one hour is elapsed. If the time elapses, step 1121 of turning off the compressor and the fan motor, starting the defrost cycling and initializing the timer associated with the compressor is performed to return to the next subroutine.

If the chamber temperature is not under the forced decreasing condition, step 1102 moves to step 1103 to determine whether the compressor is under the on-condition. If not the on-condition, at step 1117 the compressor is turned off. Under the on-condition of the compressor, step 1103 moves to step 1104 to determine whether the three minutes are elapsed. If the time has not elapsed, the next subroutine is executed. If the time elapses, step 1105 and 1106 of turning on the compressor and the fan delay timer are in turn performed. Next, at step 1107 it is determined whether the defrost cycling is elapsed. If not, elapsed the next subroutine is executed.

If the defrost cycling has elapsed, step 1107 goes to step 1108 to determine whether the first compensation is completed. If completed, steps 1118 to 1121 of dropping the temperature before entering into the defrost cycling are performed.

If the defrost cycling has not elapsed, at step 1109 the door open times of the freezing and refrigerating chambers are added to each other. Next, step 1109 passes through steps 1110, 1111 and 1112 in turn to determine whether the total door open time of the freezing and refrigerating chamber is any one of "SMALL", "MIDDLE" and "LARGE". According to each of the determined results, the defrost cycling is respectively increased through steps 1113, 1114 and 1115 by two hours, one hour and half hour. Thereafter, if the defrost cycling increasing is completed, step 1115 moves onto step 1116 to complete the first compensation and then return to the next subroutine.

If the defrost cycling is not one of the "SMALL", "MIDDLE", and "LARGE" modes, steps 1118 to 1121 of dropping the temperature before entering into the defrost cycling are performed.

Thus, the defrost time compensation method varies the defrost cycle interval based on the usage frequency of the refrigerator, permits the measuring of the chamber average temperature, and controls the frost according to the measuring result, thereby minimizing the temperature change of the chamber.

FIG. 12 is a flow chart of a defrost control routine according to the present invention.

The control portion 100 first determines whether the defrost cycling is ready to operate at step 1201. If not, ready to operate the next subroutine is performed. Under the ready state of the defrost cycling, step 1201 goes onto step 1202 to determine whether the bimetal is turned on. If the bimetal is turned on, at step 1204 the forced defrost and its time accumulation are performed, and then the next subroutine is executed.

If the bimetal is turned on, step 1202 moves to step 1203 to determine whether the forced defrost time has elapsed. If the time has elapsed, step 1203 moves to step 1205 to turn off the compressor and heater and operate the pause time timer. Next, at step 1206 it is determined whether the pause time is passed. If the pause time is not passed, the next subroutine is performed. If the pause time is passed, step 1206 goes to step 1207 to return to the first operation position, and then the next subroutine is performed.

As described above, the present invention permits a temperature adjuster to be automatically switched so that the power consumption is reduced. The defrost cycling is operated during a predetermined time period or an auxiliary time period according to the usage frequency of a refrigerator and the door open time before entering into the defrost cycle while being started after dropping the chamber temperature according to the current state of the temperature adjuster and the average value of the chamber temperature. After the completion of the defrost cycling, the operation of a compressor and a fan motor is retarded to prevent the chamber temperature from being increased, thereby minimizing the temperature change of the chamber to protect the stored food.

What is claimed is:

1. A control method for a refrigerator, said method comprising the steps of:

adjusting a chamber temperature set point value of a temperature adjuster based on an existing chamber temperature and a frequency of use of said refrigerator;

regulating said chamber temperature according to said temperature adjuster set point value and an average chamber temperature; and controlling a defrost cycle of said refrigerator based on a set time according to said frequency of use.

2. The method of claim 1 further including the step of driving a fan to control said chamber temperature according to said frequency of use.

3. The method of claim 1 further including the step of sensing a door opening and closing frequency of said refrigerator to generate said frequency of use.

4. The method of claim 1 further including the step of selecting manual operation or automatic operation of said temperature adjuster.

5. The method of claim 1 further including the step of calculating said average chamber temperature from a minimum and a maximum chamber temperature.

6. The method according to claim 1 wherein said step of adjusting further includes:

measuring a time period during which a door of said refrigerator is open; and further adjusting said chamber temperature set point value of the temperature adjuster if said measured time period exceeds a predetermined time period.

7. The method according to claim 1 wherein said step of adjusting further includes:

reducing the chamber temperature set point value of the temperature adjuster if said frequency of use is at least two during a predetermined time period; and maintaining the chamber temperature set point value of the temperature adjuster if said frequency of use is one during said predetermined time period.

* * * * *